US008875959B2

(12) United States Patent
Coretti Garijo

(10) Patent No.: US 8,875,959 B2
(45) Date of Patent: Nov. 4, 2014

(54) DEVICE FOR SUPPLYING MOLTEN METAL FOR CENTRIFUGE MACHINES

(75) Inventor: Ion Gurutz Coretti Garijo, Palau-Solita I Plegamans (ES)

(73) Assignee: Comercial Nicem-Exinte, S.A.-Coniex, Palau-Solita I Plegamans, Barcelona (ES)

( * ) Notice: Subject to any disclaimer, the term of this patent is extended or adjusted under 35 U.S.C. 154(b) by 349 days.

(21) Appl. No.: 13/320,708

(22) PCT Filed: May 25, 2010

(86) PCT No.: PCT/ES2010/070348

§ 371 (c)(1),
(2), (4) Date: Feb. 2, 2012

(87) PCT Pub. No.: WO2010/136628

PCT Pub. Date: Dec. 2, 2010

(65) Prior Publication Data

US 2012/0125955 A1 May 24, 2012

(30) Foreign Application Priority Data

May 27, 2009 (ES) ..... 200900926 U

(51) Int. Cl.
*B22D 37/00* (2006.01)
*B22D 13/10* (2006.01)

(52) U.S. Cl.
CPC ..... *B22D 13/107* (2013.01)
USPC ..... 222/594; 222/590

(58) Field of Classification Search
CPC ..... B22D 13/107
USPC ..... 222/590, 594
See application file for complete search history.

(56) References Cited

U.S. PATENT DOCUMENTS

| | | | | |
|---|---|---|---|---|
| 3,056,179 | A * | 10/1962 | Lorang | 222/63 |
| 3,522,837 | A * | 8/1970 | Giguere | 164/299 |
| 2012/0125955 | A1 * | 5/2012 | Coretti Garijo | 222/594 |

FOREIGN PATENT DOCUMENTS

| | | | |
|---|---|---|---|
| EP | 0 429 117 | A1 | 5/1991 |
| EP | 0 578 387 | A1 | 1/1994 |
| ES | 1 052 634 | U | 1/2003 |
| GB | 647314 | * | 12/1950 |
| GB | 672386 | A | 5/1952 |

OTHER PUBLICATIONS

International Search Report for corresponding International Patent Application No. PCT/ES2010/070348 mailed Jul. 21, 2010. English translation.
Written Opinion of the International Searching Authority for corresponding International Patent Application No. PCT/ES2010/070348 mailed Jul. 21, 2010. English translation.

* cited by examiner

*Primary Examiner* — Scott Kastler
(74) *Attorney, Agent, or Firm* — Merchant & Gould P.C.

(57) ABSTRACT

A supply device of molten metal for application in semi-automatic centrifuge machines with one plate or for automatic machines with three or more plates to collect the molten metal from the furnace, take it to the centrifuge and pour it into the centrifuge. The supply device occupies minimum space and allows both for a side or back furnace configuration. The device includes an automatic and programmable assembly having an arm that is radially secured on one end to the rotating shaft of a geared motor fitted to the centrifuge. On the other, the device is articulated to another vertical arm, holding a ladle at its lower end. The operation of the device is synchronized with the operation of the centrifuge, increasing productivity, reducing hazards for workers, reducing energy consumption, and improving the finish of the final product.

5 Claims, 1 Drawing Sheet

DEVICE FOR SUPPLYING MOLTEN METAL FOR CENTRIFUGE MACHINES

This application is a National Stage Application of PCT/ES2010/070348, filed 25 May 2010, which claims benefit of Serial No. U200900926, filed 27 May 2009 in Spain and which applications are incorporated herein by reference. To the extent appropriate, a claim of priority is made to each of the above disclosed applications.

OBJECT OF THE INVENTION

The present invention refers, as the heading indicates, to a device for supplying molten metal for centrifuge machines.

FIELD OF THE INVENTION

This supply device has been designed for application in semi-automatic centrifuge machines with one plate and, as well as for automatic machines with three or more plates to collect the molten metal from the furnace, take it to the centrifuge and pour it into the centrifuge, having been designed to occupy the minimum space possible and allowing both for side or back furnace configuration.

BACKGROUND OF THE INVENTION

Up to now, the operation of collecting, transporting and pouring molten metal from the furnace to the centrifuge was done manually with a sort of ladle, with all the drawbacks and/or problems this implies, such as, among others, slowness of the operation, using different amounts of metal in each operation, possible spillage of the metal on the way or hazards for workers carrying out the operation.

SUMMARY OF THE INVENTION

These drawbacks and/or problems, and others derived from them, have been solved with this invention, the operation of which is synchronised with the operation of the centrifuge, increasing productivity considerably, reducing hazards and fatigue for workers as well as energy consumption, and improving the finish of the final product.

In order to do this, the present device consists of an automatic and programmable assembly comprising an arm that is radially secured on one end to the rotating shaft of a geared motor fitted to the corresponding centrifuge and, on the other, it is articulated to another arm that hangs vertically from the former, holding a ladle at its lower end.

The arms are moved by the geared motor and the movements, speed and work sequences of the assembly are controlled by an electrical panel with PLC and variable frequency drive, selecting the functions and variations of work parameters by means of a touchscreen control panel, identifying the positions of the arms by means of a system of cams and micro switches or an encoder.

Thus, when the geared motor moves the articulated arms, it dips the ladle into the molten metal in the oven, collects a certain amount of metal and moves it to the centrifuge to pour the metal in, the amount of metal to be poured and the speed of pouring is adjustable.

In order to do this, the ladle is attached to the arm that holds it by means of a inverted U-shaped bracket secured by its centre to the arm and by its ends to the sides of the ladle, which always descends vertically either into the furnace or the centrifuge.

In addition, this ladle adapts to the level of metal in the furnace by means of a level probe, which can be advantageously be the ladle itself, this being made of stainless steel and not needing any other element that would otherwise have to be fitted to said ladle.

To fill the ladle with molten metal and then pour it, the ladle has at its bottom part a small opening with a sealing valve activated by a pneumatic cylinder so that the programmed action of the cylinder opens and closes the valve, allowing the molten metal to enter or leave.

To avoid accidents, the automated assembly has, around at least part of it, a protective screen made of a suitable material, which must be transparent or have openings so the operator can observe the assembly and control its operation.

These and other characterizing features will be best made apparent by the following detailed description whose understanding will be made easier by the accompanying sheet of drawings showing a practical embodiment being cited only by way of example not limiting the scope of the present invention.

DETAILED DESCRIPTION

Figure 1:
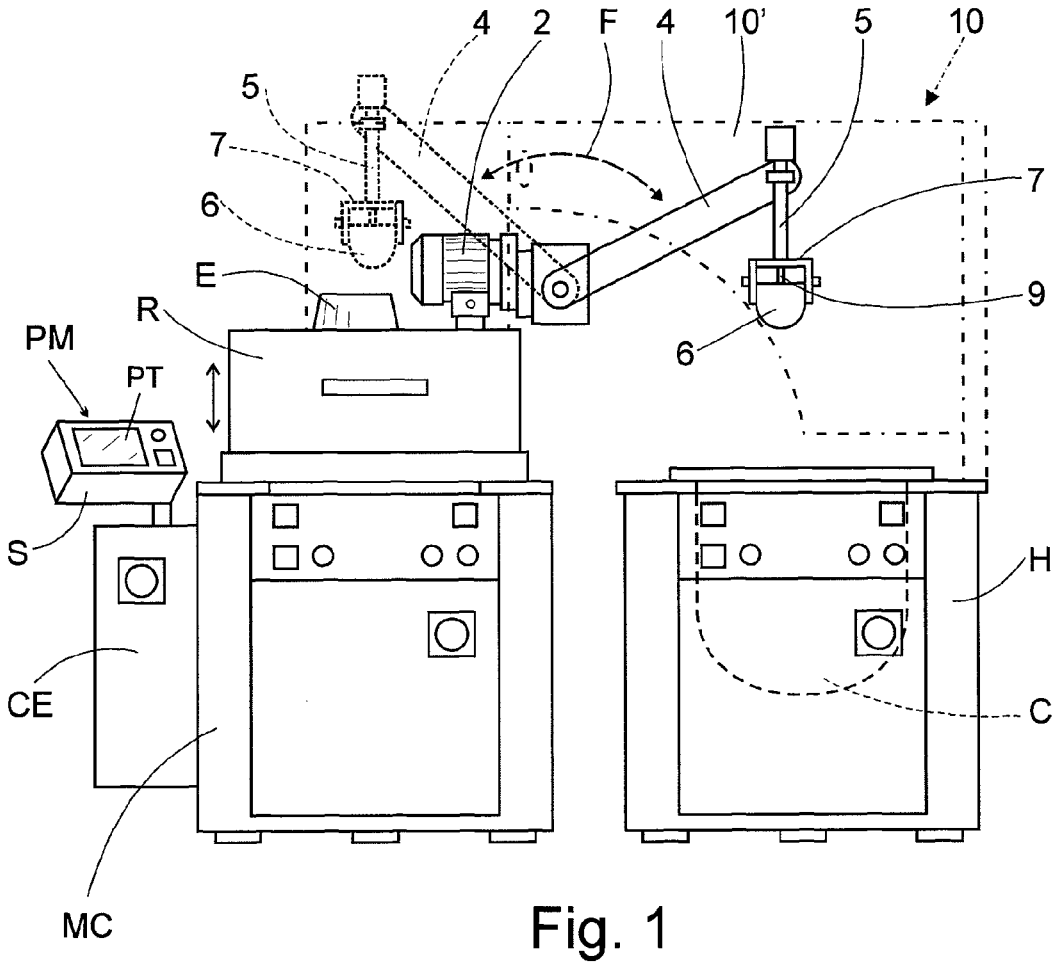
FIG. 1 is a diagrammatic front elevation view of an installation comprising a furnace, a centrifuge and the supply device described here.

According to the drawings, the device supplying molten metal for centrifuge machines consists of an automated and programmable assembly (1) comprising a geared motor (2) to the rotating shaft (3) of which is secured an arm (4) radially on one end and on the other end of which is a second tubular arm (5) that hangs from the first arm.

This second arm (5) holds the ladle from its lower end (6) by means of an inverted U-shaped bracket (7) secured to the arm from its middle point and by the ends of its sides to the sides of the ladle (6), which has at its bottom a small opening (6') sealed with a valve (8) that is activated by a pneumatic cylinder (9) fitted to the arm (5).

The assembly (1) is fitted (as illustrated in FIG. 1) to the centrifuge (MC) so that when the assembly moves the arms (4, 5) to the furnace (H) and to the centrifuge (as indicated by the arrow (F) in FIG. 1), the ladle (6) can enter the container (C) of the furnace as well as the moulding receptacle (R) of the centrifuge, which has an electrical control panel (CE) with variable frequency drive to adjust the different speeds of the geared motor (2).

The centrifuge (MC) also has a PLC (not illustrated) for the different supply functions, and a control panel. (PM) with an adjustable bracket (S) and touchscreen (PT) for entering work parameters and controlling the different functions and cycles.

Figure 2:
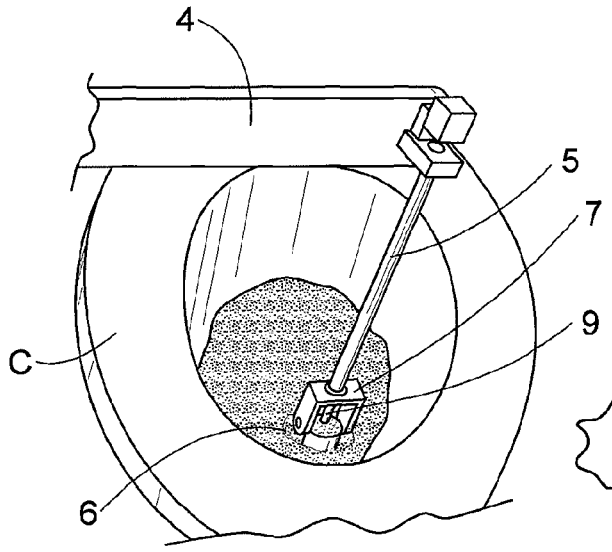
FIG. 2 illustrates partially and in perspective, the two arms of the device dipping the ladle into the furnace.

Therefore, the cycle begins with the positioning of the ladle (6) over the container (C) of molten metal of the corresponding furnace (H) and dipping the ladle into the metal (FIG. 2) to a pre-set depth in order to collect the desired amount of metal through the opening (6') at the bottom of the ladle, once the valve (8) has opened, with the entry of clean metal, because the slag is only on the surface of the molten metal.

Figure 3:
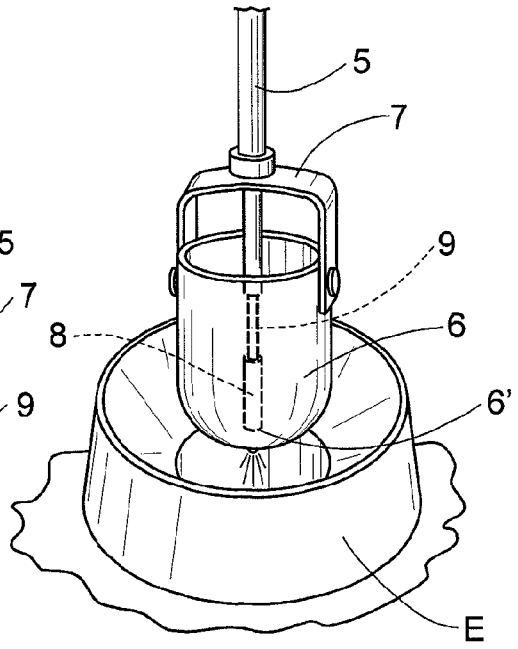
FIG. 3 shows, also in perspective, a part of the arm holding the ladle, which is pouring molten metal into the centrifuge.

Then the valve (8) will close the opening (6') of the ladle (6), and by means of a signal, the ladle will move to the funnel (E) for casting in the centrifuge (MC), being located exactly in the centre of the funnel to pour the metal it contains into the funnel (FIG. 3) after receiving the corresponding signal for the cylinder (9) over the valve (6') to open the valve.

In this part of the cycle, only the pre-set amount of metal is poured from the exact centre of the funnel area (E) as indicated, this enables better filling of the moulds than if the pouring was done manually, as well as more efficient use of molten metal in each casting. In addition, as the ladle does not empty completely (6), only clean metal is poured, even if there is some slag on the surface of the molten metal.

Once the molten metal has been poured, the ladle (6) returns to the furnace (H) and picks up more metal, awaiting the signal to begin a new cycle. If the device (1) does not receive this signal within a pre-set time, and to avoid the metal cooling, an alarm signal is triggered and the ladle (6) returns to the furnace (H), empties its contents and goes back to standby position.

To avoid accidents, the automated assembly (1) is protected by a screen (10) (the broken line in FIG. 1) which is fitted between the centrifuge (MC) and the furnace (H) and is moveable, it must also be transparent or have several openings for the assembly (1) to be observed by the operator and so be properly controlled.

In addition, the screen (10) has an access door (10') to reach the automated assembly (1) when it is necessary to inspect it or in case of any problem, as well as a safety device that stops operations when the door (10') is opened.

The invention can within its essentiality be put into practice in other embodiments differing only in detail from the one having been described above only by way of example, said other embodiments also falling within the scope of the protection being claimed. This device for supplying molten metal for centrifuge machines may thus be manufactured in any shape and size, with the most suitable means and materials and with the most convenient accessories, and the components may be replaced by others that are technically equivalent, as all of this is contained within the claims.

The invention claimed is:

1. A device for supplying molten metal for centrifuge machines, comprising an automated and programmable assembly comprising a first arm radially secured on one end to a rotating shaft of a geared motor fitted to the corresponding centrifuge machine while the other end is articulated to a second arm that hangs vertically from the first arm, holding a ladle at a lower end, wherein the ladle has an opening at a bottom of the ladle which has a sealing valve controlled by a pneumatic cylinder.

2. Device for supplying molten metal for centrifuge machines, according to the claim 1, wherein the second arm holds the ladle by an inverted U-shaped bracket attached in the middle to the second arm and is attached to the sides of the ladle from ends of the U-shaped bracket.

3. Device for supplying molten metal for centrifuge machines, according to the claim 1, wherein the automated assembly has a protective screen around at least part of the assembly.

4. Device for supplying molten metal for centrifuge machines, according to the claim 3, wherein the protective screen has an access door to reach the automated assembly.

5. Device for supplying molten metal for centrifuge machines, according to the claim 1, wherein the ladle comprises a level probe.

* * * * *